US005662385A

United States Patent [19]

Bishop

[11] Patent Number: 5,662,385

[45] Date of Patent: Sep. 2, 1997

[54] HAMMER FOR DEMOLISHING SIDEWALKS AND THE LIKE

[76] Inventor: Matt Bishop, 83 Brooksyde Ave., Ringwood, N.J. 07456

[21] Appl. No.: 522,139

[22] Filed: Aug. 31, 1995

[51] Int. Cl.[6] ..... E01C 23/12

[52] U.S. Cl. ..... 299/37.3; 404/90

[58] Field of Search ..... 299/37.1, 37.2, 299/37.3; 404/90; 37/403, 903, 443

[56] References Cited

U.S. PATENT DOCUMENTS

| | | | |
|---|---|---|---|
| 2,901,232 | 8/1959 | Lewis | 299/37.3 X |
| 3,864,793 | 2/1975 | Guest | 37/407 X |
| 4,457,645 | 7/1984 | Klochko | 299/37.3 |
| 5,234,282 | 8/1993 | Osborn | 299/37.3 X |

*Primary Examiner*—William P. Neuder
*Attorney, Agent, or Firm*—Richard A. Joel, Esq.

[57] ABSTRACT

A hammer for demolishing sidewalks and the like comprises a hammer coupled to a backhoe or skid steer loader for actuation thereby. The hammer head is mounted to a main spring which is clamped at one end to a backhoe or the bucket of a skid steer loader. Leaf springs of descending lengths are positioned adjacent the upper and lower surfaces of the main spring and affixed to the bucket or backhoe with a clamp. The springs on the upper surface of the main spring force the main spring downwardly during a hammer stroke initiated by the backhoe or bucket while the return springs force the hammer head upwardly after the stroke. The leaf spring arrangement adds a considerable whipping action to the hammer impact. The bucket is protected from excessive force generated by the whipping hammer head by the damping action of the leaf springs.

5 Claims, 3 Drawing Sheets

HAMMER FOR DEMOLISHING SIDEWALKS AND THE LIKE

BACKGROUND OF THE INVENTION

This invention relates to demolition equipment and in particular a new and improved apparatus for demolishing concrete and masonry which may be attached to a backhoe or similar equipment.

The prior art includes jack-hammers which have proved relatively unsatisfactory for purposes of concrete demolition. The traditional jack-hammer was rather slow and inefficient. Certain improvements have come about in the art and one such improvement is illustrated in U.S. Pat. No. 4,984,639 to Lindsey which discloses a hammer attached to a backhoe. U.S. Pat. No. 5,234,282 to Osborn discloses a gravity drop hammer apparatus for a skid steer loader wherein the hammer is raised and dropped under the force of gravity while the operator sits in a cab. U.S. Pat. No. 3,864,793 to Guest discloses an attachment for mounting various tools on the bucket of earth moving equipment such as backhoes and loaders. The Guest patent discloses a multiple tool attachment which could be utilized to mount demolition hammers and the like or other equipment for purposes of demolishing concrete. A power hammer utilizing leaf springs is disclosed in early U.S. Pat. No. 941,093 to Painter.

The present invention is a considerable improvement over the prior art in that the leaf spring design for coupling the hammer to the backhoe or the bucket of a skid steer loader provides an enhanced whipping action to the hammer head. The arrangement is also quite inexpensive and easy to install compared to equipment currently on the market. As a further advantage the leaf spring arrangement protects the bucket from severe disfigurement by damping the excessive destructive force generated by the hammer.

SUMMARY OF THE INVENTION

This invention comprises a new and improved apparatus for demolishing concrete and masonry. The invention includes a hammer head mounted to one end of a main spring and a second spring end which is affixed to a backhoe or a coupling attached thereto. The main spring is positioned between a plurality of leaf springs on each side which are of predetermined diminishing lengths. The upper leaf springs provide a whipping action to the cantilevered hammer while the lower springs return the main spring upwardly and enhance the whipping action when the hydraulic mechanism on the backhoe is actuated. Any excessive destructive force generated by the hammer which could effect the backhoe is dampened by the springs. The apparatus may also be mounted to the bucket of a skid steer loader.

The invention is easy to install on equipment such as backhoes and is considerably less expensive and more effective than apparatus currently on the market.

Accordingly, an object of the present invention is to provide a new and improved hammer apparatus for demolishing concrete and masonry.

Another object of this invention is to provide a new and improved apparatus for demolishing concrete and masonry which is coupled to a backhoe or similar equipment.

A further object of this invention is to provide an apparatus for demolishing masonry wherein a hammer is connected to a leaf spring arrangement which is mounted at its other end to the bucket of a skid steer loader to be driven thereby.

A more specific object of this invention is to provide a new and improved hammer mounted to one end of a main spring while the other end is coupled to a backhoe or a tractor bucket and leaf springs of varying lengths are mounted adjacent the main spring on both sides thereof to enhance the hammer whipping action and dampen the destructive force applied to the mounting attachment.

BRIEF DESCRIPTION OF THE DRAWINGS

The above an other objects and advantages of the present invention may be more clearly seen when viewed in conjunction with the accompanying drawings wherein.

DETAILED DESCRIPTION OF THE INVENTION

Figure 1:
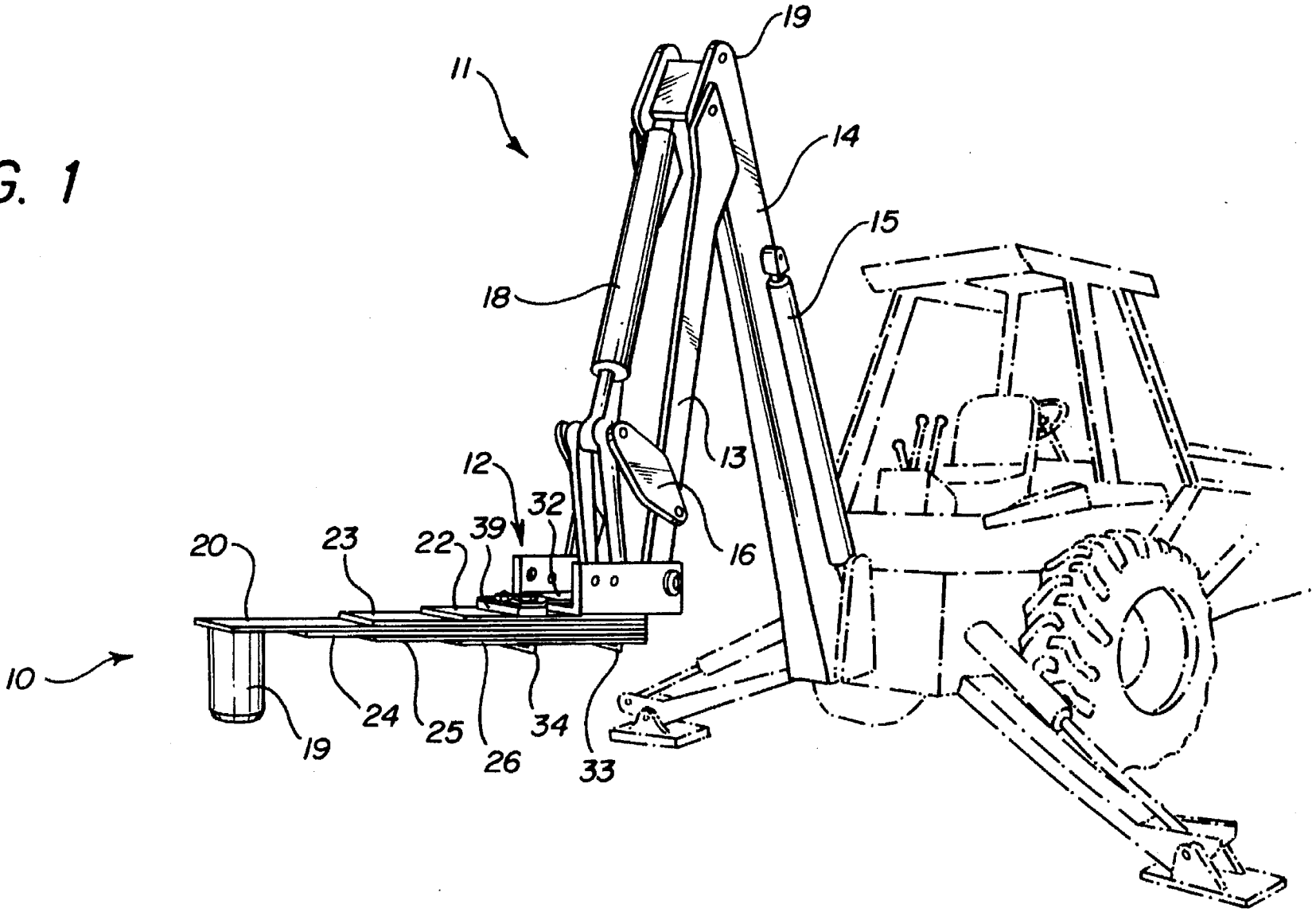
FIG. 1 shows a perspective view of the apparatus attached to a backhoe.
Figure 2:
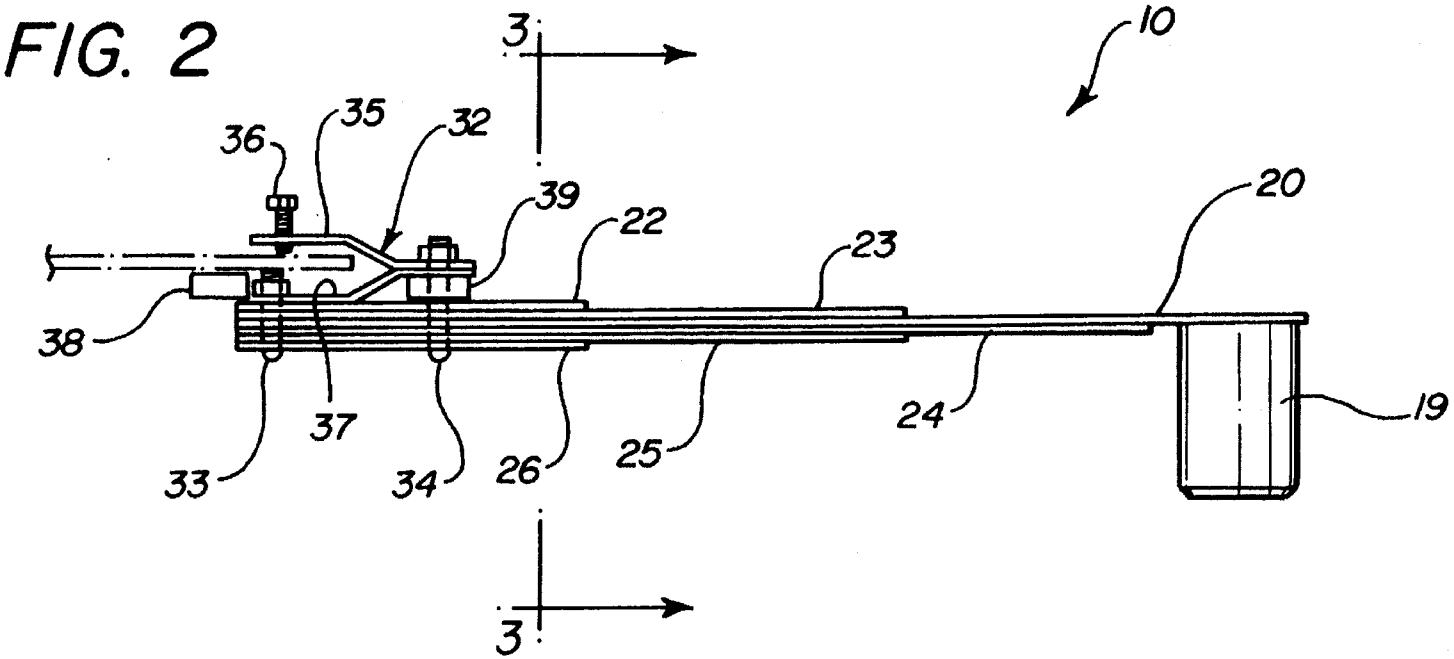
FIG. 2 is a close-up view of the invention in an enlarged view.
Figure 3:
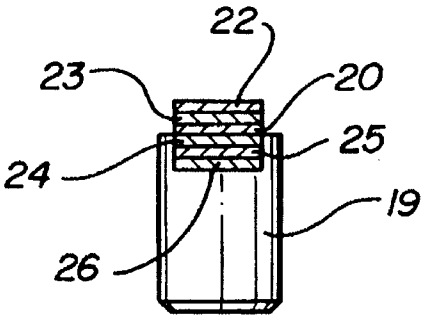
FIG. 3 discloses a cross-section through the leaf spring arrangement along the line 3—3 of FIG. 2.

Referring now to the drawings, the invention comprises a new and improved hammer 10 for demolishing concrete and masonry. The backhoe or tractor 11 is of conventional design and includes a clamp 12 mounted at the end of arm 13 which is connected at its other end to boom 14. A hydraulic cylinder 15 is mounted to the boom 14 and to the pivot assembly 16 to transfer motion to the hammer 10, 17. The boom 14 is raised or lowered by hydraulic cylinders 18.

A hammer head 19 is mounted to one end of the main leaf spring 20 with connections 21. At least two leaf springs 22 and 23 are mounted at one end to the clamp 12 similar to that disclosed in U.S. Pat. No. 3,864,795 to Guest and positioned adjacent the upper surface 24 of the main spring 20 to force the spring 20 downwardly during a hammer stroke. The spring 22 is of a shorter length than the spring 23 which is intermediate the main spring 20 and the spring 22. If additional leaf springs are utilized they would be of decreasing length. Similarly, cantilevered springs 24, 25 and 26 are located adjacent the bottom surface of the main spring 20 to force the hammer head 19 upwardly after a hammer stroke. Spring 24 is located between spring 25 and the main spring 20 and is of greater length than the spring 25.

Figure 4:
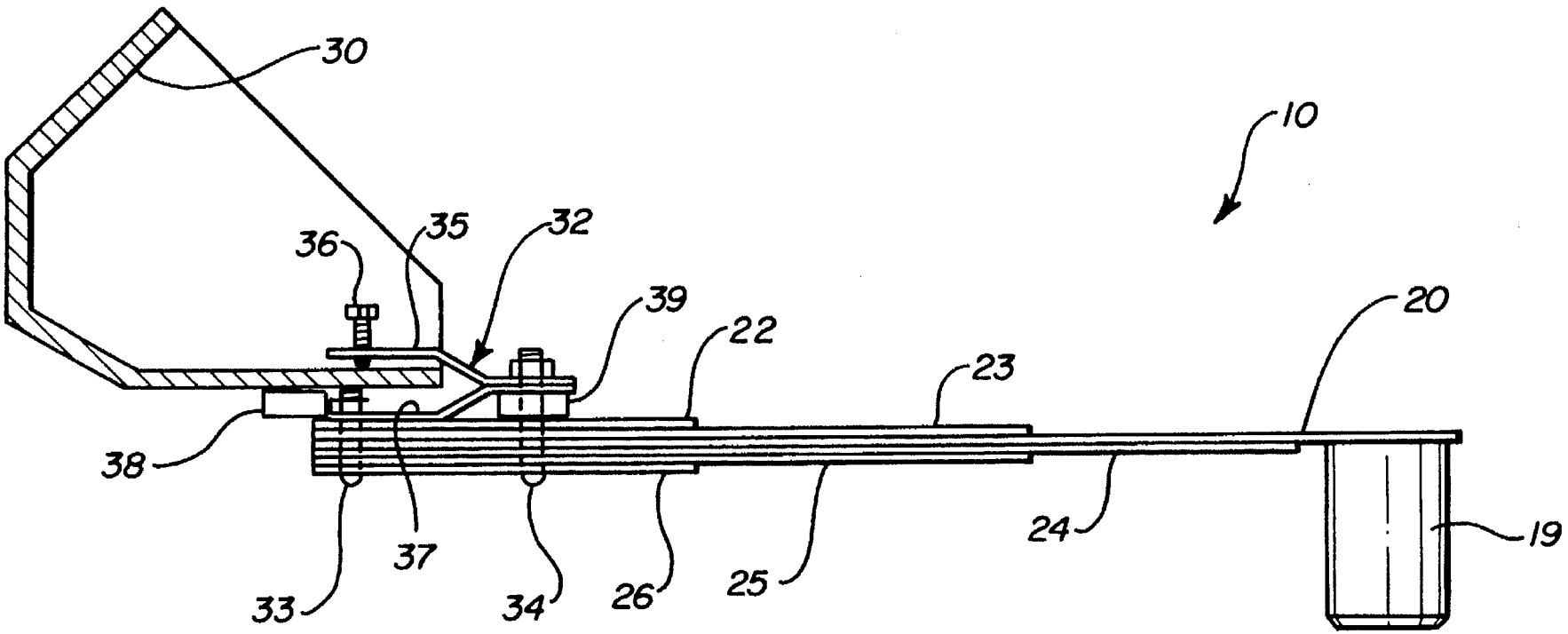
FIG. 4 discloses the apparatus coupled to the bucket of a skid steer loader

FIG. 4 depicts the hammer 10 mounted to the bucket 30 of a skid steer loader 31. The upper leaf springs 22 and 23 and the lower leaf springs 24, 25 and 26 are mounted on both sides of the main spring 20 which includes the hammer 10 at its outer end. The springs are secured to the bucket 30 with a clamp 32 which includes U-bolts 33 and 34 which extend through apertures in the springs to mount the springs in a cantilevered array. The clamp 32 includes an upper portion 35 which is secured to the bucket 30 by a tension bolt 36 and a lower portion 37 which is secured to the springs by U-bolt 34. Spacing blocks 38 and 39 maintain the relationship of the springs to the bucket 30.

In operation, the backhoe 11 is actuated to drive cylinder 15 causing the clamp 12 to move downwardly. This drives the hammer head 19 downwardly aided by the action of springs 22 and 23. The cantilevered hammer head 19 is mounted to the main spring 20 and this provides and additional whipping action to the hammer blow.

The skid steer loader 31 includes the hammer 10 mounted with a clamp 32 to the bucket 30. When the bucket 30 is driven downwardly by the hydraulic action of propelling arms (not shown), the hammer 10 is driven against the concrete surface in a whipping action by the cantilevered leaf springs 20 22 and 23. The springs 24, 25, 26 force the hammer upwardly after he stroke. All of the springs assist in a dampening action which prevents damage or disfigurement to the bucket 30.

While the invention has been explained by a detailed description of certain specific embodiments, it is understood that various modifications and substitutions can be made in any of them within the scope of the appended claims which are intended also to include equivalents of such embodiments.

What is claimed is:

1. A hammer mounted on a backhoe comprises:

a clamp mounted to the backhoe;

a main leaf spring mounted at one end to the clamp and extending outwardly therefrom, said spring having an upper and a lower surface;

a hammer head mounted to the other end of the main spring and extending downwardly therefrom;

a first leaf spring and a second leaf spring mounted to the clamp at one end and extending substantially parallel to the upper surface of the main spring, said first spring being positioned adjacent to the main leaf spring and the second spring being positioned adjacent the first spring and being of a shorter length than the first spring;

a third and a fourth leaf spring mounted to the clamp at one end and extending substantially parallel to the lower surface of the main leaf spring, said third leaf being positioned adjacent a fifth leaf spring and the fourth leaf spring being position adjacent the third leaf spring and being of a shorter length than the third leaf spring;

fifth leaf spring mounted to the clamp at one end and extending between the third leaf and the main spring and being of a greater length than all other leaf springs; and whereby the first and second leaf springs provide a whipping action to increase the force of the hammer head and the third, fourth and fifth springs provide a dampening action to prevent damage to the backhoe.

2. A hammer mounted to the bucket edge of a skid steer loader comprising:

a clamp having an upper portion located on one side of the bucket edge and a lower portion located on the other side of the bucket edge said upper and lower clamp portions extending beyond the bucket edge and first mounting means coupling the upper clamp portion to the bucket edge; and a main leaf spring, a hammer head mounted on one end of said main leaf spring and a plurality of leaf springs of varying shorter lengths being positioned adjacent the main leaf spring on both sides thereof extending outwardly from the clamp and second mounting means coupling the spring ends together and third mounting means coupling the springs to the clamp.

3. A hammer mounted to the bucket edge of a skid steer loader in accordance with claim 2 further including:

a first spacer block mounted to the end of the upper leaf springs opposite the hammer to engage the bucket and a second spacer block mounted to the third mounting means to maintain the distance between the clamp and the leaf springs.

4. A hammer mounted to the bucket edge of a skid steer loader in accordance with claim 3 wherein:

the leaf springs are positioned substantially parallel to the main spring on both sides thereof and are of varying uniform lengths increasing towards the end of the main spring.

5. A hammer in accordance with claim 2 wherein:

the main spring includes upper and lower sides and further including a plurality of leaf springs of descending lengths towards the outer spring, located on each side of the main spring, said springs being mirror images on each side of the main spring, and a single longer spring located adjacent the lower surface of the main spring and having a plurality of springs located between the lower surface of the main spring and a plurality of leaf springs.

* * * * *